US005401935A

United States Patent [19]

Smith et al.

[11] Patent Number: 5,401,935

[45] Date of Patent: Mar. 28, 1995

[54] FUEL HEATING ASSEMBLY

[75] Inventors: Kevin W. Smith; Terry L. Hygema, both of North Webster, Ind.

[73] Assignee: Heaters Engineering, Inc., North Webster, Ind.

[21] Appl. No.: 69,031

[22] Filed: May 28, 1993

[51] Int. Cl.[6] ..... F02M 53/02; H05B 3/14

[52] U.S. Cl. ..... 219/206; 219/504; 219/530; 219/540

[58] Field of Search ..... 392/480, 484; 219/205-208, 504, 505, 530, 540; 123/549, 557

[56] References Cited

U.S. PATENT DOCUMENTS

| | | | |
|---|---|---|---|
| 1,223,124 | 4/1917 | Thompson . | |
| 3,648,669 | 3/1972 | Rank . | |
| 3,762,378 | 10/1973 | Bitonti . | |
| 3,999,525 | 12/1976 | Stumpp et al. . | |
| 4,245,589 | 1/1981 | Ryan . | |
| 4,284,043 | 8/1981 | Happel . | |
| 4,325,341 | 4/1982 | Yamauchi et al. | 123/549 X |
| 4,327,697 | 5/1982 | Wada et al. | 123/549 |
| 4,366,798 | 1/1983 | Goto et al. | 219/206 X |
| 4,395,993 | 8/1983 | Tanaka et al. | 123/549 |
| 4,398,522 | 8/1983 | Kuroiwa et al. | 123/549 |
| 4,399,796 | 8/1983 | Kato et al. | 123/549 |
| 4,407,252 | 10/1983 | Dilliner . | |
| 4,458,654 | 7/1984 | Tuckey . | |
| 4,458,655 | 7/1984 | Oza . | |
| 4,489,232 | 12/1984 | Wada et al. | 219/206 |
| 4,572,146 | 10/1989 | Grunwald et al. | 123/549 |
| 4,627,405 | 12/1986 | Imhof et al. | 123/549 |
| 4,665,881 | 5/1987 | Wade . . | |
| 4,754,741 | 7/1988 | Houtman . | |
| 4,760,818 | 8/1988 | Brooks et al. | 123/557 X |
| 4,821,696 | 4/1989 | Kaczynski et al. . | |
| 4,870,249 | 9/1989 | Kayanuma et al. | 219/206 |
| 4,870,943 | 10/1989 | Bradley . | |
| 4,874,924 | 10/1989 | Yamamoto et al. . | |
| 4,886,032 | 12/1989 | Asmus . | |
| 4,898,142 | 2/1990 | Van Wechem et al. . | |
| 5,095,879 | 3/1992 | Matsushima . | |
| 5,119,794 | 6/1992 | Kushida et al. . | |
| 5,159,915 | 11/1992 | Saito et al. | 123/557 |

FOREIGN PATENT DOCUMENTS

| | | | |
|---|---|---|---|
| 2843534 | 4/1979 | Germany | 123/557 |
| 56-6056 | 1/1981 | Japan | 123/549 |
| 4-350360 | 12/1992 | Japan | 123/557 |

*Primary Examiner*—Teresa J. Walberg
*Attorney, Agent, or Firm*—Barnes & Thornburg

[57] ABSTRACT

A heater assembly for electrically heating fuel subsequent to its being sprayed from a fuel injector has a body that receives an end portion of the fuel injector and a heating structure. The heating structure includes a heat sink formed from an electrically and thermally conductive metal or metal alloy having an opening formed therein for receiving fuel sprayed from the nozzle of the fuel injector, one or more integrally formed flats on an exterior surface of the heat sink, and one or more substantially flat heating elements mounted in heat conducting relation to the flats. The substantially flat heating elements may be formed from Positive Temperature Coefficient material. An electric supply is provided for powering the one or more heating elements and a control device is provided for regulating the power supplied from the electric supply. An electrically conductive spring is used to complete an electric circuit between the heat sink, the one or more substantially flat heating elements, the electric supply, and the control device. The spring may also be used to mount the one or more substantially flat heating elements to the one or more integrally formed flats.

30 Claims, 3 Drawing Sheets

FUEL HEATING ASSEMBLY

The present invention is directed to fuel injection systems, and particularly to an apparatus for electronically heating fuel during cold starting and warm-up of an internal combustion engine. More particularly, the present invention is directed to an electronically-controlled heater having a heat sink with at least one integrally formed flat thereon to which at least one piece of material made from a PTC element is attached to heat the fuel subsequent to its being sprayed from a nozzle of the fuel injector.

Gasoline and diesel fuel engines generate power to turn a crankshaft via a controlled explosion occurring within one or more cylinders (or combustion chambers) of these engines. Engine cylinders each have a reciprocating piston disposed within, the piston being formed from high-strength, high-temperature metal, that is connected to the crankshaft via a rod. In operation, vacuum created within the engine directs ambient air into an intake manifold of the engine where it is eventually mixed with gasoline or diesel fuel and introduced into the cylinder which is then sealed. This air-fuel mixture is then compressed a predetermined amount via travel in one direction of the piston disposed within the cylinder (known as the "compression stroke") at which point it is then exploded, forcing the piston to travel in the opposite direction, providing a "power stroke" to turn the crankshaft to which it is connected via the rod. After reaching the full extent of the power stroke, the piston then reciprocates in its initial direction either to remove the combustion by-product or compress a new air-fuel mixture, depending, respectively, on whether the engine is a "four-cycle" or a "two-cycle" engine.

Two methods are used to provide an air-fuel mixture. One method involves the use of a carburetor, the other method involves the use of one or more fuel injectors. Carburetors are used to mechanically regulate the mixture of air and fuel through a series of vacuum and throttle controlled plates and openings (also known as "barrels"). Carburetors consist of a multitude of components and are mounted on the intake manifold of the internal combustion engine.

Fuel injectors are used to spray gasoline or diesel fuel into an incoming ambient airstream so as to provide an air-fuel mixture that is introduced into the combustion chamber of the engine. The basic components of a typical fuel injector are a body portion that is removably mounted in an access port of the engine, a fuel passageway that extends therethrough for communication with a gasoline or diesel fuel supply source, a nozzle, and an electronically or mechanically movable valve for controlling metered discharge of the gasoline or diesel fuel from the nozzle.

Fuel injected engines have at least one advantage over carbureted engines (engines that utilize a carburetor to create the proper air-fuel mixture). Fuel injected engines provide engine performance that is more precisely reactive to throttle changes due to more efficient fuel distribution resulting from the short time lapse between throttle movements and fuel injection. This results in fuel injected engines generally having more acceleration and power than carbureted counterparts.

Emission, power, and economy problems exist with engines during cold starting and warm-up because gasoline or diesel fuel should reach a certain temperature (ideally at least the temperature at which it vaporizes) before it will most efficiently mix with an incoming ambient airstream and self-ignite or ignite with the assistance of a spark. If the fuel is insufficiently warmed, then optimal infusion with the incoming ambient airstream will not occur. This will manifest itself in increased harmful engine hydrocarbon emissions resulting from unburnt fuel being expelled from the combustion chamber (most harmful auto emissions occur within the first two minutes of cold engine start-up), reduced piston power stroke (essentially, a less violent explosion occurs inside the combustion chamber), and greater fuel consumption resulting from the need to use more fuel to obtain equivalent warm engine performance.

To combat this problem, various methods are used to heat the gasoline or diesel fuel to a predetermined temperature during cold engine operation. Once the engine is warm enough to passively heat the fuel, these supplemental heating methods are turned off. An electric heater is typically used to actively heat the fuel prior to its mixture with the incoming ambient airstream. U.S. Pat. No. 4,870,943 to Bradley for a "Thermal Liquid Pump" describes apparatus that heats fuel prior to spraying via a resistance coil. U.S. Pat. No. 4,458,655 to Oza for a "Fuel Injection Nozzle with Heated Valve" also describes apparatus that heats fuel prior to spraying via a heating wire. U.S. Pat. No. 4,821,696 to Kaczynski et al. for a "Device for Injecting Fuel Into a Combustion Chamber of an Internal Combustion Engine" describes apparatus that heats fuel subsequent to spraying via a glow coil. Finally, U.S. Pat. No. 1,223,124 to Thompson for a "Vaporizer and Igniter for Internal Combustion Engines" describes apparatus that also heats fuel subsequent to spraying via a glow coil.

Heating fuel subsequent to spraying has at least one advantage over heating prior to spraying. Heating fuel subsequent to spraying allows any amount of heat to be added to the fuel, whereas only a limited amount can be added prior to spraying because too much heat may cause the fuel to vaporize. If the fuel vaporizes prior to spraying, incorrectly metered amounts may be dispensed from the nozzle of the fuel injector.

Another method of heating gasoline or diesel fuel is through the use of a thermistor of Positive Temperature Coefficient (PTC) material such as doped barium titanate. See, for example, U.S. Pat. No. 4,898,142 to Van Wechem et al. for a "Combustion Engine With Fuel Injection System, And A Spray Valve For Such An Engine" which describes apparatus that uses PTC material to heat the gasoline or diesel fuel prior to spraying. Resistance of PTC material increases as its temperature increases until a maximum temperature is reached at which point no further temperature increase will occur. This makes PTC material an excellent choice for applications requiring a fixed maximum temperature. This maximum temperature control is important in applications where the PTC material is used to heat gasoline or diesel fuel prior to spraying because, as described previously, too much heat will cause gasoline or diesel fuel to vaporize prior to spraying. Also, PTC material has a considerably large energy density and reaches maximum temperature quickly. These properties make PTC material well-suited for operating in colder environments. Finally, use of certain shapes of PTC provides a less expensive heating means than those mentioned in the preceding paragraph.

The use of PTC material to heat gasoline or diesel fuel subsequent to spraying from the nozzle of a fuel injector would allow even further exploitation of the use of PTC material beyond that currently used. Specifically, because PTC material has a high energy density and reaches maximum temperature quickly, large quantities of heat can be added to the gasoline or diesel fuel subsequent to spraying. This will help to vaporize the gasoline or diesel fuel and thus greatly enhance infusion with the incoming ambient airstream, thereby reducing harmful emissions, power loss, and excess fuel consumption.

SUMMARY OF THE INVENTION

Accordingly, the present invention comprises an improved heater assembly for electrically heating fuel sprayed from a fuel injector nozzle mounted adjacent an air inlet passage which opens into a combustion chamber of an engine. The heater assembly has a body and a heat sink disposed within the body, downstream of the fuel sprayed from the nozzle. The body is constructed from polyamide, polyphenylene sulfide, or other high temperature filled materials.

The heat sink has an opening formed therein through which fuel sprayed from the nozzle can travel, one or more integrally formed flats on the exterior surface thereof, and one or more substantially flat heating elements mounted in heat conducting relation to the flats. An air gap may be provided between the body and heat sink in order to reduce heat transfer therebetween. At least one protrusion on the exterior surface of the heat sink may be used to facilitate the provision of the air gap. The opening formed in the heat sink may be a bore angularly extending through the heat sink. With regard to the flats, they may be parallel to the opening and may also angularly extend from the exterior surface thereof, for at least a portion of the length of the heat sink. Ribs or other similar structure may be formed on the interior surface of the opening of the heat sink to increase the surface area thereof. The heat sink is preferably constructed from an electrically and thermally conductive material such as metal or a metal alloy. Preferred materials include copper and tin.

In the embodiment illustrated in the drawings, the heat sink is divided into an upper portion and a lower portion. The lower portion has flats formed on it to which the one or more substantially flat heating elements are mounted. The upper and lower portions are connected via a section of the heat sink that is smaller in cross-section than either the upper or lower portions in order to reduce the transfer of heat energy from the lower portion to the upper portion.

The embodiment of the heater assembly shown in the drawings also includes a collar disposed adjacent an interior surface of the upper portion and resting on a ledge portion of the section. The collar is intended to provide a surface for an end portion of the fuel injector to abut against.

In the embodiment illustrated in the drawings, the one or more substantially flat heating elements are formed from Positive Temperature Coefficient (PTC) elements. While PTC elements are used, it is understood that other equivalent material may be used.

A spring is used to mount the one or more substantially flat heating elements to the one or more integrally formed flats. The spring may be formed from a substantially flat piece of substantially rectangularly-shaped metal having substantially parallel flat upper and lower surfaces, four edges, and pairs of strips that are in one-to-one correspondence with the number of substantially flat heating elements. The strips extend in opposite directions from a longitudinal axis of the substantially flat piece of substantially rectangularly-shaped metal and are biased so as to hold a substantially flat heating element to an integrally formed flat. These strips may be substantially crescent-shaped in cross-section.

A locking assembly is used to secure the spring in a substantially circular shape that is used to hold down the one or more heating elements formed by wrapping the spring around itself in the direction of its longitudinal axis so that the ends of the substantially rectangularly-shaped metal overlap. The locking assembly includes grooves and a tab formed on one of the ends, the grooves being substantially parallel to the longitudinal axis of the substantially rectangularly-shaped metal, and a notch formed in the opposing end. When the spring is wrapped around itself in the direction of the longitudinal axis, the end with the notch formed therein is inserted into the grooves of the opposing end so that the tab engages the notch to securely lock the spring in a substantially circular shape. In the preferred embodiment illustrated in the drawings, the notch is substantially D-shaped and the tab is substantially crescent-shaped.

The heat sink and spring may be constructed from electrically conductive material and connected to an electrical power and control source. In this configuration, an electrical circuit is completed between the heat sink, each of the one or more substantially flat heating elements, the spring and the electrical power and control source. In such a configuration, no portion of the spring should come in physical contact with the heat sink. If this happens, an electrical short will occur.

Other objects, advantages and novel features of the present invention will become apparent from the following detailed description of the invention when considered in conjunction with the accompanying drawings.

DETAILED DESCRIPTION OF THE DRAWINGS

Figure 1:
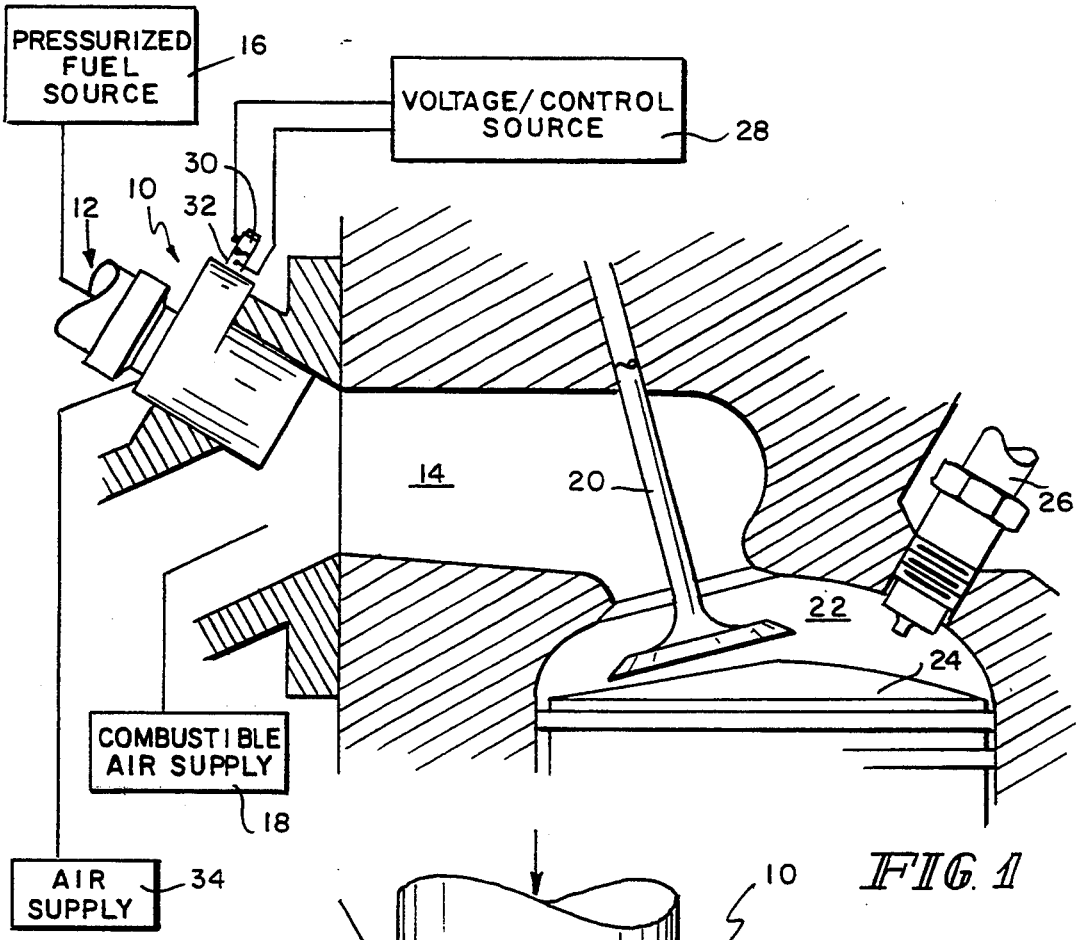
FIG. 1 shows a diagrammatic illustration of an engine having a heat assembly.

FIG. 1 shows a diagrammatic illustration of an engine having a heater assembly 10 with a fuel injector 12 disposed therein. The combination of the heater assembly 10 and fuel injector 12 is shown mounted in air-inlet channel 14 of the engine. The heater assembly 10 is used to heat cold or cool fuel supplied from pressurized fuel source 16 immediately prior to its infusion with combustible air supply 18 admitted into the engine via air-inlet channel 14. This heating is done to enhance the mixing of the fuel with the combustible air supply 18 in order to reduce harmful emissions occurring during cold engine start-up.

FIG. 1 also shows intake valve 20 that admits an air-fuel mixture into combustion chamber 22. Combustion chamber 22 has a reciprocating piston 24 disposed therein as well as a spark plug 26 used to ignite the air-fuel mixture admitted into combustion chamber 22 via intake valve 20. Also shown in FIG. 1 is voltage/-control source 28 used to provide power to heat heater assembly 10 for a limited period of time. Voltage/control source 28 is shown connected to plugs 30 and 32 of heater assembly 10. Finally, an air supply 34 is shown connected to heater assembly 10. The function of air supply 34 will be described with reference to FIG. 2.

Figure 2:
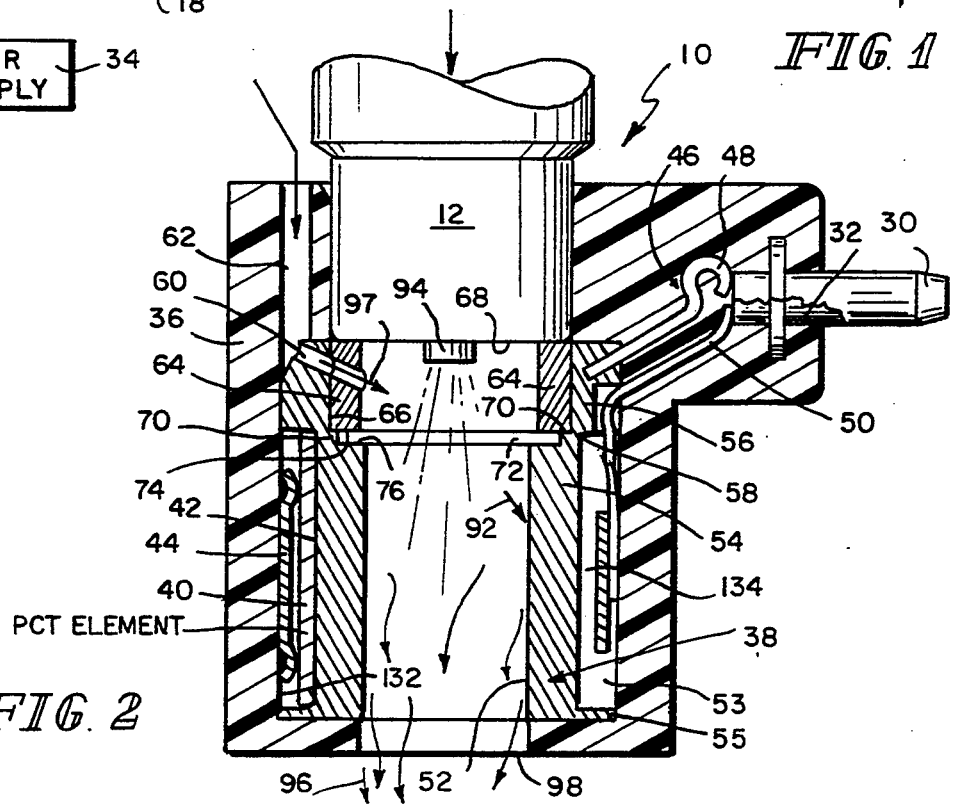
FIG. 2 shows a transverse section through the heater assembly shown in FIG. 1.

FIG. 2 shows a transverse section through the heater assembly 10 shown in FIG. 1. Heater assembly 10 includes a body 36 that surrounds other components of heater assembly 10. Body 36 is made from polyamide, polyphenylene sulfide, or other high temperature filled material. Body 36 is used to mount heater assembly 10 in the air-inlet channel 14 of the engine as described above with reference to FIG. 1. Body 36 also protects the other components of heater assembly 10 from physical damage caused by contact with other objects. Finally, body 36 provides an insulation barrier that helps to hold in heat generated by the other components of heater assembly 10 so that fuel sprayed from fuel injector 12 is heated rather than surrounding engine parts.

Heater assembly 10 also includes a heat sink 38 having one or more of Positive Temperature Coefficient (PTC) elements 40 such as doped barium titanate mounted in heat conducting relationship to exterior surface 42 and heat sink 38 via spring 44. PTC material is electrically conductive. The resistance of PTC material increases as its temperature increases until a maximum temperature is reached at which point no further temperature increase will occur. This makes PTC material an excellent choice for applications requiring a fixed maximum temperature. This maximum temperature control is important for this application where PTC material is used to heat fuel because too much heat will cause fuel to vaporize prior to being sprayed from the nozzle of fuel injector 12. Improperly metered amounts of fuel may be dispensed from fuel injector 12 if the fuel is vaporized prior to spraying. Also, PTC material has a considerably large energy density and reaches maximum temperature quickly. These properties make PTC material well-suited for operating in colder environments. While PTC material is used in the embodiments shown in the figures, it is understood that other equivalent material may be used in conjunction with the present invention.

The PTC elements are heated via an electrical terminal assembly 46 that provides power via an electrical circuit between heat sink 38, each of the PTC elements 40 and spring 44. A first terminal 48 is shown connected between plug 30 and heat sink 38 which is made from an electrically conductive material such as copper or tin. A second terminal 50 is shown connected between plug 32 and spring 44 that holds each of the PTC elements 40 on the exterior surface 42 of heat sink 38. Each of the PTC elements 40 are resistors in this circuit. Thus, as current flows through the circuit, power is dissipated in the one or more PTC elements 40 which manifests itself as heat energy. This heat energy is transferred from the exterior surface 42 of heat sink 38 to the interior surface 52 thereof because the material from which heat sink 38 is constructed (copper or tin) is thermally conductive. An air gap 53 extends between body 36 and heat sink 38. Air gap 53 provides an insulative barrier between body 36 and heat sink 38 in order to reduce heat transfer therebetween. Protrusion 55 on exterior surface 42 of heat sink 38 is used to facilitate the provision of air gap 53.

As can be seen in FIG. 2, heat sink 38 includes a lower portion 54 and an upper portion 56. Lower portion 54 and upper portion 56 are connected via section 58 which has a smaller cross-sectional area than lower and upper portions 54 and 56 so as to aid in thermally isolating lower portion 54 from upper portion 56. That is, lower and upper portions 54 and 56 are separated so that the majority of heat remains in lower portion 54. Upper portion is intended to allow for connection of first terminal 48 and the diagonal portion 60 of air passage 62, the purpose of which will be described below.

A collar 64 is shown disposed adjacent the interior surface 66 of upper portion 56. Collar 64 is retained in position by ledges 70 formed on heat sink 38. Collar 64 provides a surface for end portion 68 of fuel injector 12 to abut against. As discussed with reference to FIG. 1, fuel injector 12 is disposed within heater assembly 10 and heater assembly 10 is in turn disposed in air-inlet channel 14 of the engine. The depth of insertion of fuel injector 12' in heater assembly 10 is controlled via abutment of end portion 68 with collar 64. Collar 64 limits the depth of insertion of fuel injector 12 within heater assembly 10. Air gap 72 is provided between the bottom surface 74 of collar 64 and the top surface 76 of lower portion 54. Air gap 72 is designed to provide an insulative barrier to reduce heat transfer between lower portion 54 of heat sink 38 and collar 64.

In another embodiment of heater assembly 10, upper portion 56 of heat sink 38 extends in the area where collar 64 is shown in FIG. 2. In this alternative embodiment, end portion 68 of fuel injector 12 abuts against upper portion 56 of heat sink 38 rather than collar 64. An air gap, similar to air gap 72 shown in FIG. 2, is provided between lower and upper portions 54 and 56 in order to reduce heat transfer between the two. Ledges 70, shown in FIG. 2, are absent from this alternative embodiment.

In operation, fuel 92 sprayed from nozzle 94 of fuel injector 12 is deflected by air 97 traveling down through air passage 62 and diagonal portion 60 supplied by air supply 34 so that fuel 92 is deflected and comes in contact with interior surface 52 of heat sink 38. Heat energy transferred from the one or more PTC elements 40 to the interior surface 52 heats fuel 92 up to and beyond the point of vaporization to enhance infusion with combustible air supplied by combustible air supply 18, thereby reducing harmful engine emissions. Resultant fuel vapor 96 is shown in the lower portion and at the bottom 98 of heater assembly 10. Voltage/control source 28 (shown in FIG. 1) only provides power to the one or more PTC elements 40 for a limited period of time until the engine has reached a predetermined temperature at which point it can passively heat the fuel sprayed from nozzle 94 of fuel injector 10.

Figure 3:
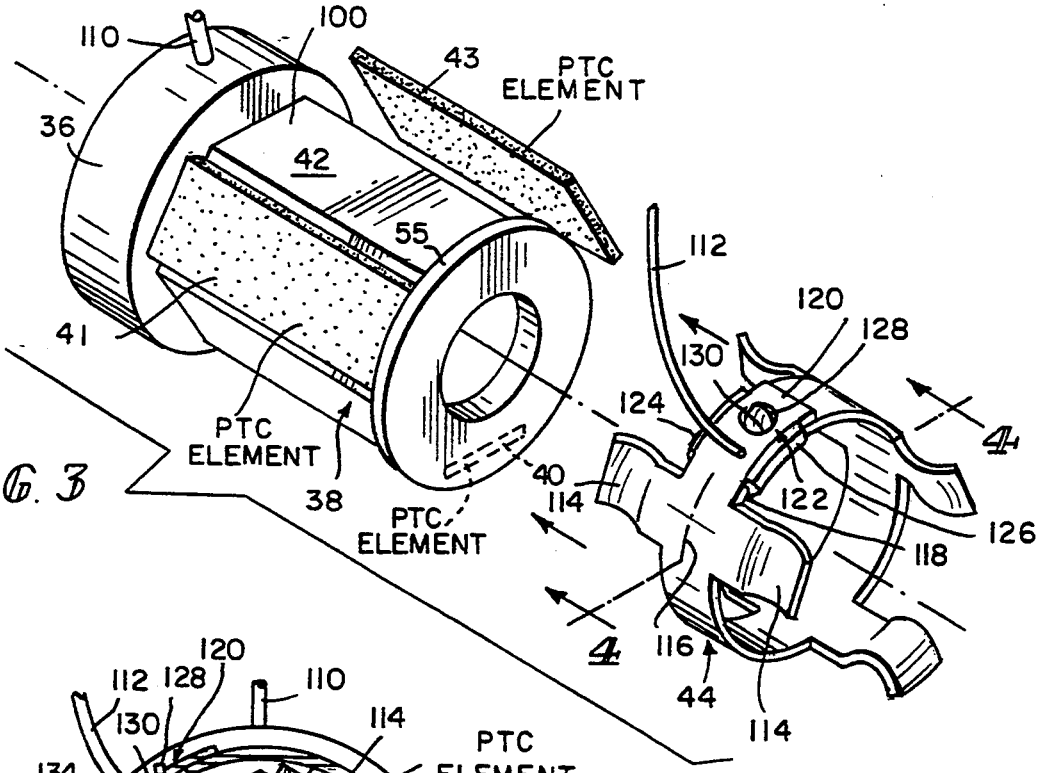
FIG. 3 is an exploded view of the heat sink, related heating elements, and spring of the heater assembly.

FIG. 3 shows an exploded perspective view of heat sink 38, PTC elements 40, 41, and 43, spring 44, electrical conductors 110 and 112 connected respectfully to heat sink 38 and spring 44, and a portion of body 36. As can be seen, heat sink 38 has a plurality of flats 100 formed on the exterior surface 42 thereof. As can also be seen, PTC elements 40, 41 and 43 are substantially flat and rectangular in shape. There is a cost savings advantage associated with the use of substantially flat PTC elements 40, 41 and 43. PTC material starts out as a clay-like slurry that can be formed into various shapes in addition to the substantially flat shape used in the present invention. Such shapes might include, for example, a cylinder or annular ring. However, it is more difficult and expensive to form such shapes because PTC material tends to develop stress fractures during sintering due to its shrink rate of approximately two-to-one. The substantially flat, rectangular shape of the PTC elements used in the present invention, on the other hand, develop stress fractures less often because of the less complex, essentially two-dimensional geometry.

As discussed previously, spring 44 can be used to attach PTC elements 40, 41 and 43 to the flats 100 formed on exterior surface 42. Spring 44 is formed from a substantially flat piece of substantially rectangularly-shaped metal with at least one pair of substantially rectangularly-shaped strips 114 that extend in opposite directions from a longitudinal axis 116 (shown in dashed lines in FIG. 3). As can be seen from FIG. 3, the number of pairs of strips 114 corresponds to the number of PTC elements 40, 41 and 43 to be attached to flats 100 so that there is one pair of strips 114 for each PTC element 40, 41 and 43.

Figure 4:
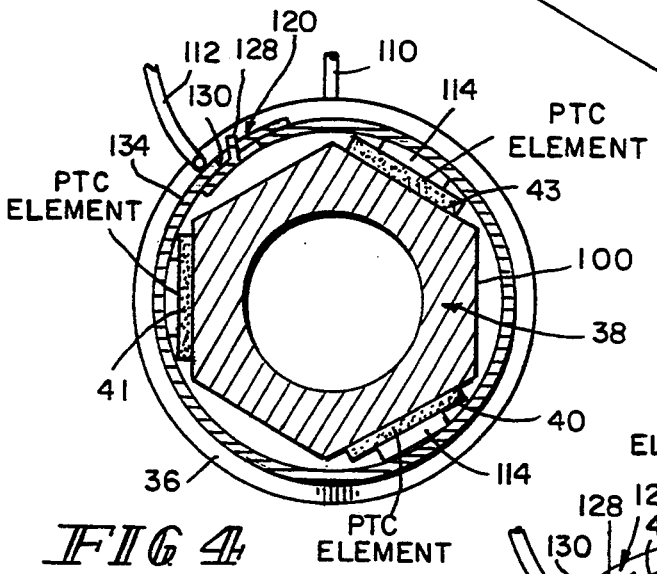
FIG. 4 is a sectional view taken along line 4—4 of FIG. 3.

Spring 44 is formed into the closed shape shown in FIG. 3 by wrapping spring 44 around itself in the direction of longitudinal axis 116 so that the ends 118 and 120 thereof overlap. Spring 44 is held in the closed substantially circular shape shown in FIG. 3 via a locking assembly 122. Locking assembly 122 includes two opposing grooves 124 and 126 formed in end 118 that extend substantially parallel to one another and a substantially crescent-shaped tab 128 formed therein. End 120 has a substantially D-shaped notch 130 formed therein. As can be seen from the combination of FIG. 3 and FIG. 4 (a sectional view of heater assembly 10 taken along line 4—4 of FIG. 3 showing three PTC elements 40, 41 and 43 mounted to heat sink 38) as well as FIG. 5 (the sectional view of FIG. 4 showing six PTC elements 40, 41, 43, 45, 47, and 49), locking assembly 122 holds spring 44 in the substantially circular shape shown via insertion of end 120 into grooves 124 and 126 of end 118 so that substantially crescent-shaped tab 128 extends through substantially D-shaped notch 130. The resiliency of spring 44 provides an outward bias radially directed away from the center of spring 44 that ensures that tab 128 will remain firmly secured within substantially D-shaped notch 130.

Referring again to FIG. 3, it can be seen that strips 114 have a cross-sectional substantially crescent or parabolic shape. While a particular curvature for strips 114 is shown in the figures, it is understood that other equivalent curvatures may be used in connection with the present invention. As shown in FIG. 2, strips 114 of spring 44 are biased so as to press against and secure each of the substantially flat PTC elements to a flat 100 via contact with inner surface 132 of body 36.

Figure 5:
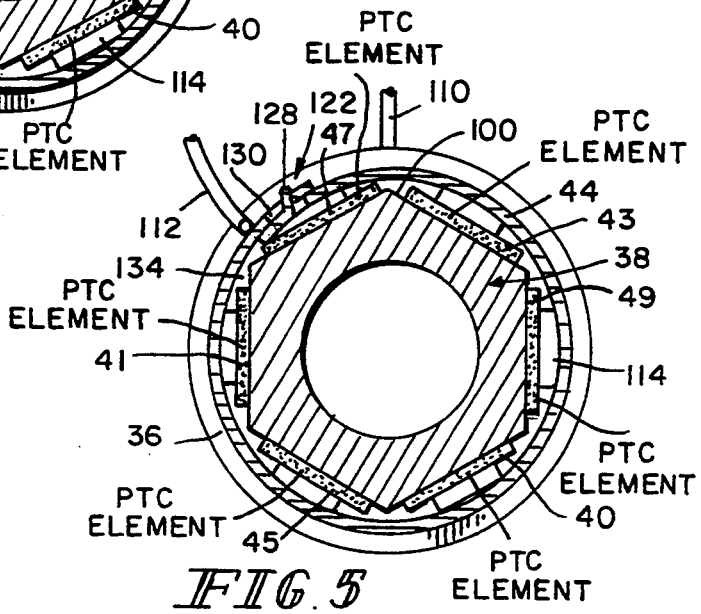
FIG. 5 is a sectional view identical to that shown in FIG. 4 except that six heating elements are shown rather than three.

As will be appreciated with reference to FIGS. 2, 4, and 5, a space 134 must be provided between heat sink 38 and spring 44 because the circuit used to heat the PTC elements 40, 41 and 43 is completed through contact between spring 44, PTC elements 40, 41 and 43, and heat sink 38. If spring 44 and heat sink 38 contact at any point, a short will develop and the PTC elements will not be heated. It is understood that an equivalent insulative barrier other than air, such as paper, may also be used to electrically isolate spring 44 from heat sink 38.

Figure 6:
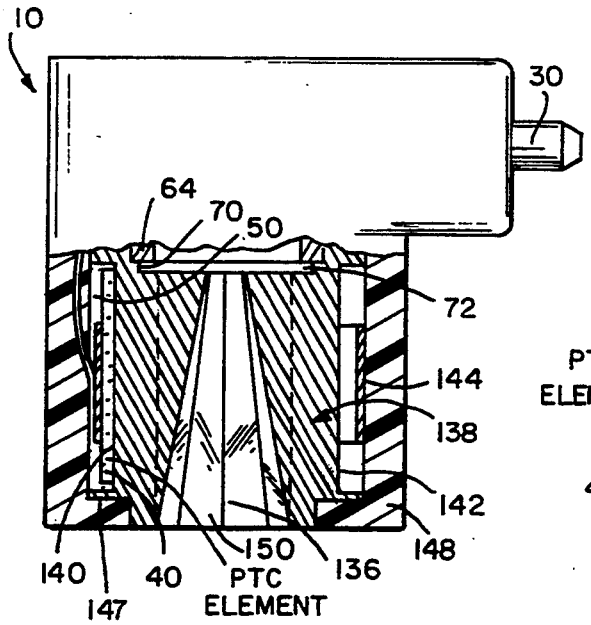
FIG. 6 is a side elevational view of another embodiment of the heater assembly broken away to reveal internal converging ribs.

FIG. 6 shows a side elevational view of another embodiment of a heater assembly 10 with portions broken away to reveal internal converging ribs 136 formed in heat sink 138. PTC elements 40, 41 and 43 are mounted on flats 140 formed on exterior surface 142 of heat sink 138. Collar 64, ledges 70, and air gap 72 are shown and provide the same function as that described with reference to FIG. 2. Second terminal 50 is also shown connected to spring 144. Spring 144 provides electrical connection between PTC elements 40, 41 and 43 and heat sink 138 as with spring 44. An air gap 146 extends between body 148 and heat sink 138. Air gap 146 provides an insulative barrier between body 148 and heat sink 138 in order to reduce heat transfer therebetween. Protrusion 147 on exterior surface 142 of heat sink 138 is used to facilitate the provision of air gap 146. Bore 150 is angled so that it matches the spray pattern of fuel (not shown) sprayed from a fuel injector nozzle (also not shown).

Figure 7:
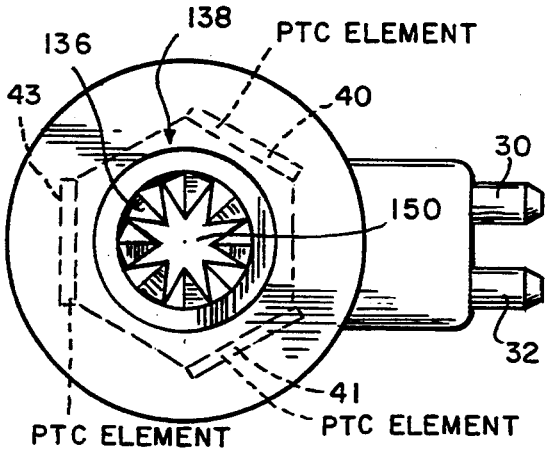
FIG. 7 is a bottom view of FIG. 6.

As can be seen from the bottom view of FIG. 6 shown in FIG. 7, ribs 136 project inward toward the center of bore 150 in heat sink 138. Ribs 136 are used to provide more surface area onto which fuel sprayed from nozzle 94 (not shown) can come in contact.

Figure 8:
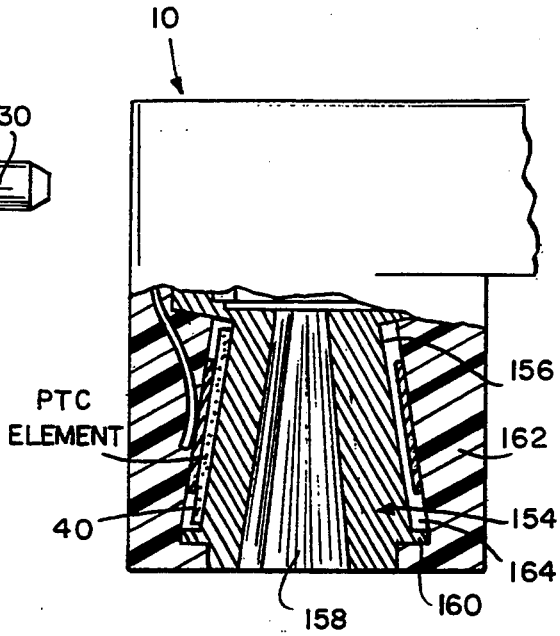
FIG. 8 is a side elevational view of yet another embodiment of the heater assembly broken away to reveal internal converging heating elements.
Figure 9:
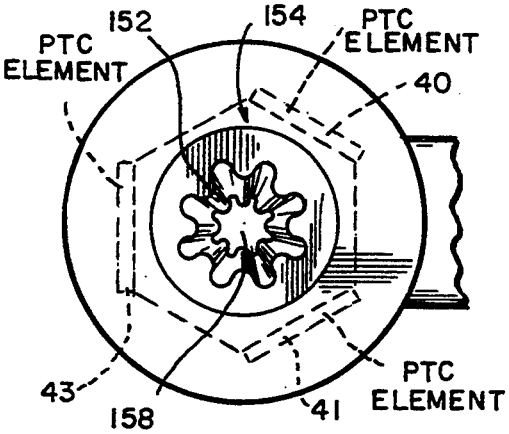
FIG. 9 is a bottom view of FIG. 8.

FIG. 8 shows a side elevational view of yet another embodiment of heater assembly 10 with portions broken away to reveal internal converging heat exchange projections 152 (shown in FIG. 9) formed in heat sink 154. The embodiment of FIG. 8 except for the shape of heat exchange projections 152, the angled exterior surface 156 of heat sink 154, and protrusion 160 is the same as that shown in FIG. 6.

As with ribs 136, heat exchange projections 152 project inward toward the center of bore 158 (shown in FIG. 9) formed in heat sink 154. Heat exchange projections 152 are also used to provide more surface area onto which fuel sprayed from nozzle 94 (not shown) can come in contact. Exterior surface 156 is angled so as to provide a uniform cross-sectional area along the length of heat sink 154. Protrusion 160 helps ensure that air gap 164 is provided. Air gap 164 provides an insulative barrier between body 162 and heat sink 154 in order to reduce heat transfer therebetween.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A heater assembly for electrically heating fuel sprayed from a fuel injector mounted adjacent an air-inlet channel that opens into a combustion chamber of an engine, said fuel injector having a nozzle from which it sprays fuel supplied by a pressurized fuel source so that said fuel infuses with a combustible air supply in the air-inlet channel, said heater assembly comprising:

a body;

a heating means disposed within the body and downstream of the fuel sprayed from a fuel injector nozzle, said heating means including a heat sink having an opening formed therein for receiving fuel sprayed from the nozzle, at least one integrally formed flat on an exterior surface thereof, and a substantially flat heating element mounted in heat conducting relation to each flat;

electric supply means for providing power to each heating element;

control means for controlling the supply of power from the electric supply means to said heating element; and a spring for mounting the substantially flat heating element to the at least one integrally formed flat;

wherein the spring is formed from a substantially flat piece of substantially rectangularly-shaped metal; and further wherein the substantially flat piece of substantially rectangularly-shaped metal has substantially parallel flat front and rear faces, upper and lower edges, first and second joined ends and pairs of strips in one-to-one correspondence with the number of substantially flat heating elements, said pair of strips extending from said upper and lower edges in opposite directions from a longitudinal axis of said substantially flat piece of substantially rectangularly-shaped metal and biased so as to hold each substantially flat heating element to the integrally formed flat upon which it is mounted.

2. The heater assembly of claim 1, wherein the strips are substantially crescent-shaped in cross-section.

3. The heater assembly of claim 1, further including a locking assembly that secures the spring in a substantially circular shape formed by wrapping said spring around itself in the direction of the longitudinal axis thereof so that said ends of the substantially rectangularly-shaped metal overlap.

4. The heater assembly of claim 3, wherein the locking assembly includes grooves and a tab formed on one of the ends, said grooves being substantially parallel to the longitudinal axis of the substantially rectangularly-shaped metal, and a notch formed in the opposing end so that when the spring is wrapped around itself in the direction of the longitudinal axis thereof the end with the notch formed therein is inserted into the grooves of the opposing end in order for the tab thereof to engage the notch to securely lock the spring in said substantially circular shape.

5. The heater assembly of claim 4, wherein the notch is substantially D-shaped and the tab is substantially crescent-shaped.

6. The heater assembly of claim 4, wherein the heat sink and spring are constructed from electrically conductive material, are electrically respectively connected to opposite poles of the electrical supply and control means, and oriented so that no portion of said spring comes in direct physical contact with said heat sink so that an electrical circuit is completed between the heat sink, each of the substantially flat heating elements, the spring, the electric supply means, and the control means.

7. A fuel heating assembly, comprising:

a heat sink having an interior surface that defines a bore through the heat sink and an exterior surface, a portion of which is configured to include a flat that defines a first surface area on the exterior surface;

a substantially flat heating element coupled to the heat sink adjacent the flat, the substantially flat heating element having a positive temperature coefficient and two dimensions that define a second surface area substantially conforming to the first surface area of the flat;

first and second conductors for supplying electrical power to the heating element; and a thermally insulating overmolded body for encasing and securing the heat sink, conductors, and heating element together, the body having a first end that includes an inlet opening communicating with said bore and configured to mount to a fuel injector nozzle end and a second end having an outlet communicating with said bore through which fuel supplied by the nozzle end of the fuel injector exits.

8. The fuel heating assembly of claim 7, wherein the heat sink is further configured to provide an air gap between the flat of the heat sink and the overmolded body to reduce heat transfer between the heat sink and overmolded body.

9. The fuel heating assembly of claim 8, wherein a protrusion formed on the exterior surface of the heat sink provides the air gap.

10. The fuel heating assembly of claim 7, wherein the body is made from a material selected from the group consisting of polyamide, polyphenylene sulfide, and other high temperature synthetic resins.

11. The fuel heating assembly of claim 7, wherein the heat sink is further configured so that the flat is substantially parallel to the bore.

12. The fuel heating assembly of claim 7, wherein the heat sink is further configured so that the flat angularly extends away from a longitudinal axis through a center of the bore.

13. The fuel heating assembly of claim 7, wherein the heat sink is further configured so that the bore angularly extends through the heat sink away from a longitudinal axis through a center of the bore.

14. The fuel heating assembly of claim 7, wherein the heat sink is electrically conductive, and further wherein the heat sink is made from one of the group consisting of a thermally conductive metal and a metal alloy.

15. The fuel heating assembly of claim 14, wherein the heat sink is made from one of the group consisting of copper and tin.

16. The fuel heating assembly of claim 14, wherein the power supply means is connected to the heat sink.

17. The fuel heating assembly of claim 7, wherein the heat sink is further configured to include an upper portion and a lower portion connected together by a section having a smaller cross-sectional area to facilitate thermal isolation of the upper and lower portions, and further wherein the flat is on the lower portion.

18. The fuel heating assembly of claim 17, wherein the section is configured to include a ledge, and further comprising a collar adjoining an interior surface of the upper portion and the ledge.

19. The fuel heating assembly of claim 7, wherein the interior surface of the heat sink is configured to include ribs directed towards a center of the bore of the heat sink.

20. The fuel heating assembly of claim 7, wherein the interior surface of the heat sink is configured to include heat exchange projections directed towards a center of the bore of the heat sink.

21. The fuel heating assembly of claim 7, wherein the exterior surface of the heat sink is configured to include six flats that each define a separate surface area on the exterior surface of the heat sink, and further comprising three separate substantially flat heating elements each coupled to the heat sink adjacent separate flats and each having a positive temperature coefficient and two dimensions that define a surface area substantially conforming to the surface of the flat to which the heating element is coupled.

22. The fuel heating assembly of claim 7, wherein the exterior surface of the heat sink is configured to include six flats that each define a separate surface area on the exterior surface of the heat sink, and further comprising six separate substantially flat heating elements each coupled to the heat sink adjacent separate flats and each having a positive temperature coefficient and two dimensions that define a surface area substantially conforming to-the surface of the flat to which the heating element is coupled.

23. A fuel heating assembly, comprising:

a heat sink having an interior surface that defines a bore through the heat sink and an exterior surface, a portion of which is configured to include a flat that defines a first surface area on the exterior surface;

a substantially flat heating element coupled to the heat sink adjacent the flat, the substantially flat heating element having a positive temperature coefficient and two dimensions that define a second surface area substantially conforming to the first surface area of the flat;

an overmolded body encasing the heat sink and heating element, the body having a first end that includes an inlet opening communicating with said bore and configured to include means for mounting to a fuel injector nozzle end and a second end having an outlet communicating with said bore through which fuel supplied by the nozzle end of the fuel injector exits; and means formed in the overmolded body and heat sink for deflecting fuel sprayed from the nozzle end of the fuel injector onto the interior surface of the heat sink defining the bore.

24. The fuel heating assembly of claim 23, wherein the deflecting means includes an air passage in fluid communication with an air supply.

25. A fuel injecting assembly, comprising:

a fuel injector having an input end into which fuel is supplied and an output end through which the fuel exits;

a thermally insulating overmolded body coupled to the fuel injector adjacent the output end;

a heat sink encased within the body adjacent the fuel injector and configured to include a bore, defined by an interior surface of the heat sink, and a flat on an exterior surface of the heat sink, said bore communicating with the output end of said fuel injector through said overmolded body and having an outlet end through which fuel supplied to the bore from the output end of the injector exits; and a heating element coupled to the flat between the body and heat sink to promote vaporization of the fuel that has exited the output end of the fuel injector.

26. The fuel injecting assembly of claim 25, wherein the flat defines a first surface area on the exterior surface of the heat sink and further wherein the heating element is substantially flat, has a positive temperature coefficient, and is configured to have two dimensions that define a second surface area substantially conforming to the first surface area of the flat.

27. The fuel injecting assembly of claim 26, wherein the exterior surface of the heat sink is configured to include six flats that each define a separate surface area on the exterior surface of the heat sink, and further comprising three separate substantially flat heating elements each coupled to the heat sink adjacent separate flats and each having a positive temperature coefficient and two dimensions that define a surface area substantially conforming to the surface of the flat to which the heating element is coupled.

28. The fuel injecting assembly of claim 26, wherein the exterior surface of the heat sink is configured to include six flats that each define a separate surface area on the exterior surface of the heat sink, and further comprising six separate substantially flat heating elements each coupled to the heat sink adjacent separate flats and each having a positive temperature coefficient and two dimensions that define a surface area substantially conforming to the surface of the flat to which the heating element is coupled.

29. The fuel injecting assembly of claim 25, further comprising means formed on the interior surface of the heat sink for increasing the surface area of the bore.

30. The fuel injecting assembly of claim 29, wherein the increasing means includes one of the group of ribs and heat exchange projections both of which are directed towards a center of the bore of the heat sink.

* * * * *